US009168191B1

(12) United States Patent
Langley

(10) Patent No.: US 9,168,191 B1
(45) Date of Patent: Oct. 27, 2015

(54) ADJUSTABLE WHEELCHAIR FOOT BRACKET

(71) Applicant: Helen Langley, Garden Grove, CA (US)

(72) Inventor: Helen Langley, Garden Grove, CA (US)

( * ) Notice: Subject to any disclaimer, the term of this patent is extended or adjusted under 35 U.S.C. 154(b) by 0 days.

(21) Appl. No.: 14/623,651

(22) Filed: Feb. 17, 2015

Related U.S. Application Data

(60) Provisional application No. 61/940,661, filed on Feb. 17, 2014.

(51) Int. Cl.
*A61G 5/12* (2006.01)

(52) U.S. Cl.
CPC ..... *A61G 5/12* (2013.01); *A61G 2005/128* (2013.01)

(58) Field of Classification Search
CPC ..... A61G 5/12; A61G 2005/128
USPC ..... 280/748; 180/90.6; 296/75
See application file for complete search history.

(56) References Cited

U.S. PATENT DOCUMENTS 2,572,149 A * 10/1951 Hind et al. ..... 280/290
7,121,572 B1 * 10/2006 Jaffe et al. ..... 280/304.1

* cited by examiner

*Primary Examiner* — Faye M Fleming
(74) *Attorney, Agent, or Firm* — Williams Intellectual Property; Benjamin F. Williams

(57) ABSTRACT

An adjustable wheelchair foot bracket that is releasably attachable to the footplate of a wheelchair between an attached position and an unattached position. The foot bracket includes an attachment member having a first plate and a second plate disposed in parallel to superimpose upon either side of a wheelchair footplate and frictionally engage the footplate therebetween. A rubberlike foot guard is disposed arcuately normal the attachment member, and curves to shield the foot of a user riding in the wheelchair, around said user's toes to terminate in a position proximal the tarsus of said user's foot. Impacts of the foot guard with objects externally situated relative the wheelchair act to compress the foot bracket directionally toward the attached position, whereby the attached position in maintained during use.

2 Claims, 3 Drawing Sheets

ADJUSTABLE WHEELCHAIR FOOT BRACKET

CROSS-REFERENCE TO RELATED APPLICATIONS

This nonprovisional application for utility patent claims the benefit of provisional application No. 61/940,661 filed on Feb. 17, 2014

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of wheel chair foot accessories are known in the prior art. However, what is needed is an adjustable wheelchair foot bracket that includes at least one attachment member and at least one foot guard, said attachment member readily attachable to an extant wheelchair footplate, whereby a foot, resting upon said footplate, is protectable from impact with external objects.

FIELD OF THE INVENTION

The present invention relates to an adjustable wheelchair foot bracket, and more particularly, to an adjustable wheelchair foot bracket that includes at least one attachment member and at least one foot guard, said attachment member having a first plate and a second plate disposed in parallel to superimpose upon either side of the footplate frictionally engaged therebetween, whereby the foot bracket is readily attachable to an extant wheelchair footplate, and a foot, resting upon said footplate, is protectable from impact with objects situated externally relative the wheelchair.

SUMMARY OF THE INVENTION

The general purpose of an adjustable wheelchair foot bracket, described subsequently in greater detail, is to provide an adjustable wheelchair foot bracket which has many novel features that result in an adjustable wheelchair foot bracket which is not anticipated, rendered obvious, suggested, or even implied by prior art, either alone or in combination thereof.

Feet are often exposed when a user is operating a wheelchair. This can result in minor injuries. Furthermore, said user is often restricted in movement and is thereby unable to expel large amounts of effort on application of wheelchair accessories. Wheelchair users, therefore, require an adjustable footplate accessory that protects feet and is adapted to be expediently attachable and removable from a wheelchair footplate.

The present adjustable wheelchair foot bracket has been devised to be releasably attachable to a footplate of a wheelchair whereby the selective use of the adjustable wheelchair foot bracket is enabled and a foot is, thereby, protectable when placed on the footplate during operation of the wheelchair.

The adjustable wheelchair foot bracket includes at least one attachment member and at least one foot guard. The attachment member includes a first plate and a second plate that are disposed in parallel. The wheelchair footplate is slidable between the first plate and second plate, said first plate and second plate frictionally engaging said footplate, whereby the attachment member is attachable to said footplate. The foot guard is disposed upon the attachment member and protrudes arcuately normal the footplate in a curved plane protective of a foot resting on said foot plate.

When the adjustable wheelchair foot bracket is needed, the adjustable wheelchair foot bracket is expediently slid onto the footplate to frictionally engage said footplate between the first plate and second plate in an attached position. When the adjustable wheelchair foot bracket is not needed, the adjustable wheelchair foot bracket is readily slid off the footplate to an unattached position.

Impact of the foot guard with objects in the surrounding environment does not dislodge the adjustable wheelchair foot bracket from the attached position as force applied to the front of the foot guard during normal operation of the wheelchair directs the attachment member towards the attached position whereby the adjustable wheelchair foot bracket is maintained in the attached position.

Thus has been broadly outlined the more important features of the present adjustable wheelchair foot bracket so that the detailed description thereof that follows may be better understood and in order that the present contribution to the art may be better appreciated.

For better understanding of the adjustable wheelchair foot bracket, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
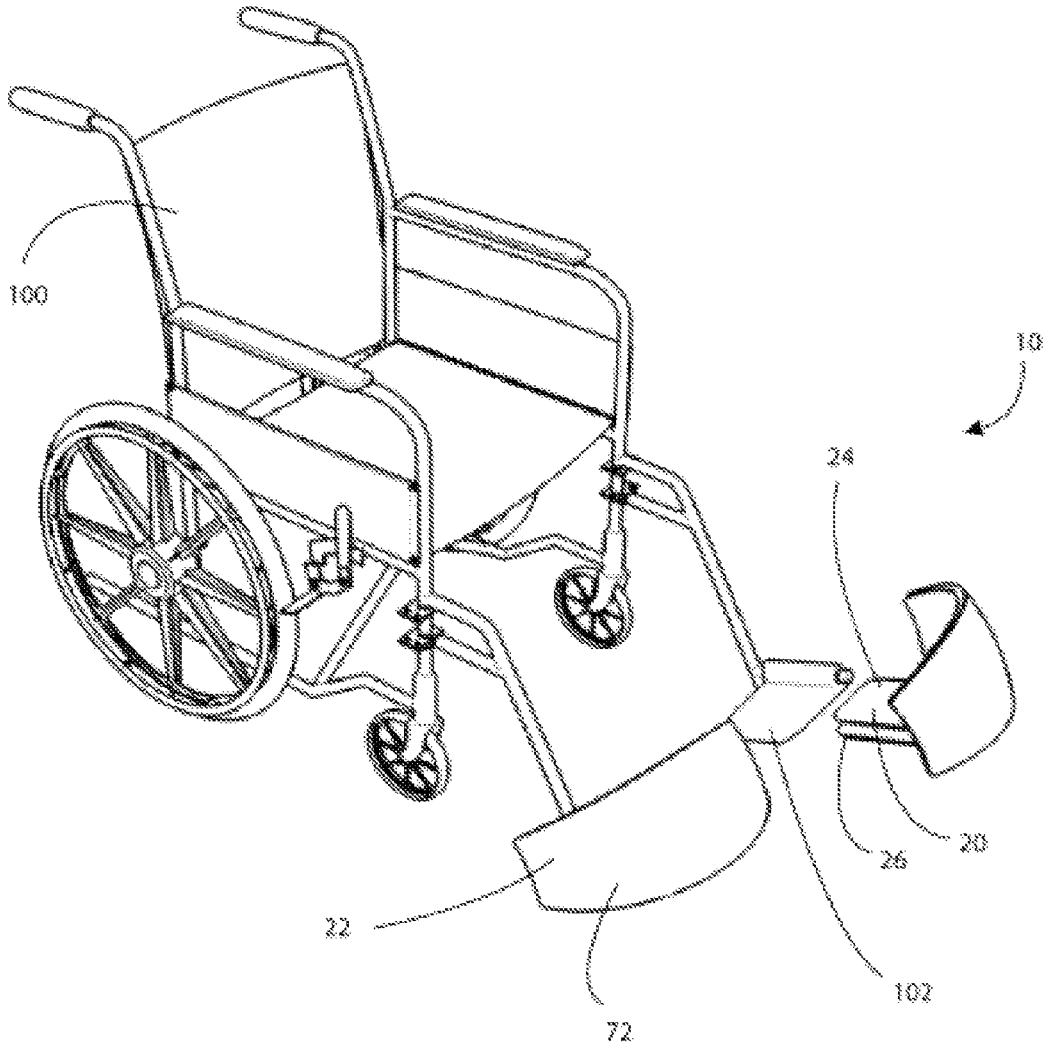
FIG. 1 is a frontal isometric view of an embodiment.
Figure 2:
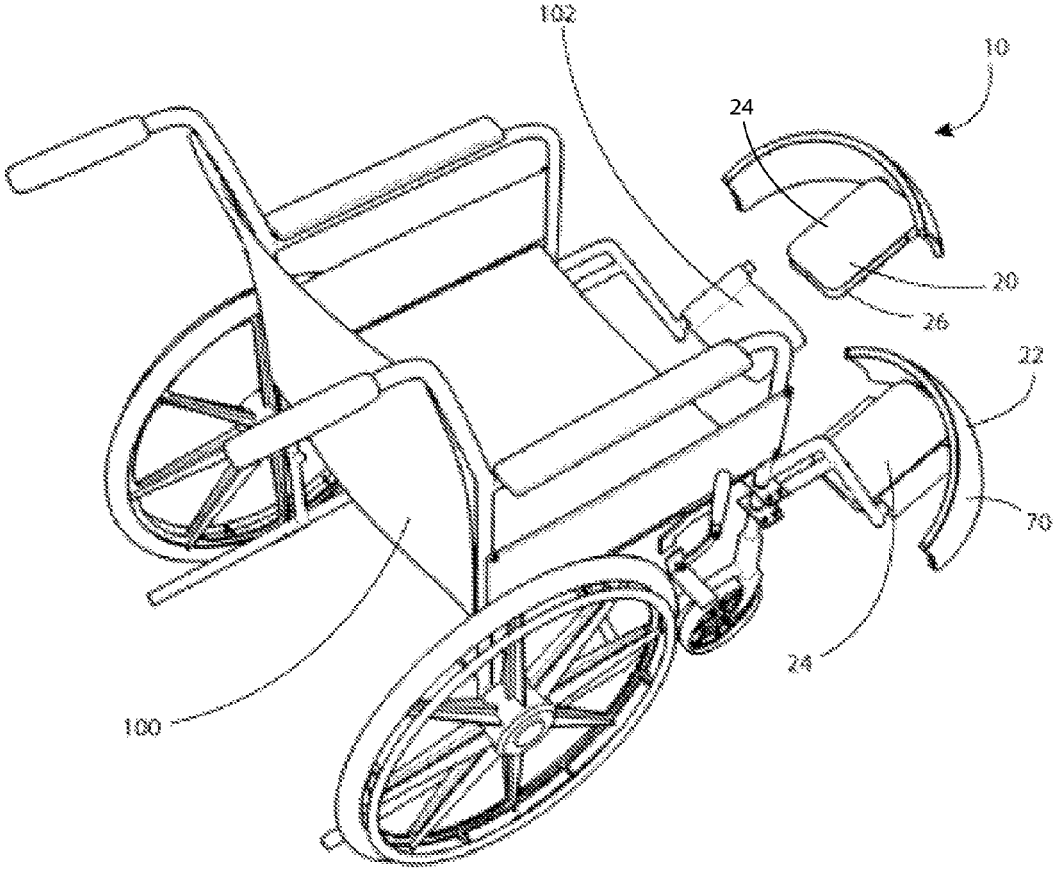
FIG. 2 is a rearward isometric view of an embodiment.
Figure 3:
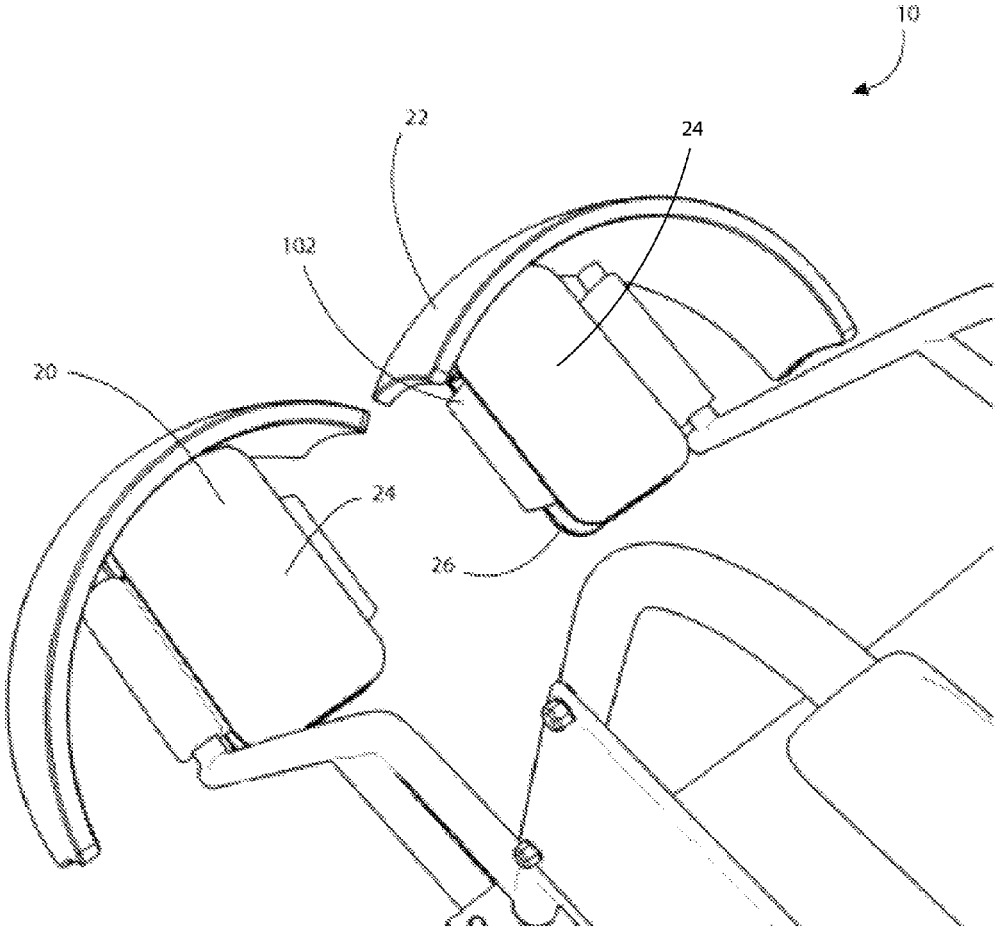
FIG. 3 is a close-up isometric view of an embodiment.

With reference now to the drawings, and in particular FIGS. 1 through 3 thereof, example of the instant adjustable wheelchair foot bracket employing the principles and concepts of the present adjustable wheelchair foot bracket and generally designated by the reference number 10 will be described.

Referring to FIGS. 1 through 3 a preferred embodiment of the present adjustable wheelchair foot bracket 10 is illustrated.

The present adjustable wheelchair foot bracket 10 has been devised to be releasably attachable to a footplate 102 of an extant wheelchair 100 whereby the selective use of the adjustable wheelchair foot bracket 10 is enabled and a foot is, thereby, protectable when resting on the footplate 102.

The present adjustable wheelchair foot bracket 10 includes at least one attachment member 20 and at least one foot guard 22.

In an example embodiment herein disclosed, the attachment member 20 has a length corresponding to the length of the footplate 102. The attachment member 20 includes a first plate 24 and a second plate 26. The first plate 24 is disposed in parallel with the second plate 26 and the footplate 102 is slidable therebetween. The attachment member 20 is thus frictionally engagable to the footplate 102 in an attached position. A user riding in the wheelchair 100 assists maintaining the attachment member 20 in the attached position by position of said user's foot resting upon the first plate 24.

In an example embodiment herein disclosed, the foot guard 22 is contemplated to be comprised of an impact absorbent material, such as rubber for example, or another polymeric or rubberlike material. The foot guard 22 is disposed upon the end of the attachment member 20 and protrudes arcuately normal to the footplate 102 whereby a foot is protectable when said foot is rested on the footplate 102. The foot guard 22 curves from a position around the toe of a foot of a user to a position proximal the tarsals of said user's foot.

The adjustable wheelchair foot bracket 10 is fittable between an attached position and an unattached position. When the adjustable wheelchair foot bracket 10 is needed, the attachment member 20 is slid onto the footplate 102, said footplate 102 frictionally engaged between the first plate 24 and the second plate 26 of said attachment member 20, and the adjustable wheelchair foot bracket 10 is disposed in the attached position. A foot of a user is thence positional upon the first plate 24 of the attachment member whereby the adjustable wheelchair foot bracket 10 is maintainable in the attached position.

When the adjustable wheelchair foot bracket 10 impacts with an external object, the attached position is maintained due to the impact applying a force in the direction of said attached position. When the adjustable wheelchair foot bracket 10 is not needed, the adjustable wheelchair foot bracket 10 is slid off of the footplate 102 whereby said adjustable wheelchair foot bracket 10 is disposed in the unattached position.

What is claimed is:

1. An adjustable wheelchair foot bracket comprising:

an attachment member releasably attachable to a footplate of a wheelchair, said attachment member having a first plate and a second plate disposed in parallel; and a foot guard disposed arcuately normal the attachment member, said foot guard disposed to curve around the toe of a foot of a user riding in the wheelchair, said foot guard terminating in a position proximal the tarsals of said user's foot;

wherein the footplate of a wheelchair is positional in between said first and second plates and frictionally engaged therebetween, said attachment member thereby removably positional in an attached position upon the footplate, to protectively shield a user's foot from impact with objects disposed within a line of contact when the wheelchair is volubly engaged, whereby a user's foot is disposed atop the first plate and impacts with the foot guard occurring during normal operation of the wheelchair compress the foot guard to engage the attachment member towards the attached position whereby the attachment member is readily maintainable in the attached position during use.

2. An adjustable wheelchair foot bracket releasably attachable to a wheelchair footplate between an attached position and an unattached position, said adjustable wheelchair foot bracket comprising:

an attachment member releasably attachable to a footplate of a wheelchair, said attachment member having a first plate and a second plate disposed in parallel bounding a space therebetween, each of said first and second plate having a length at least as long as the wheelchair footplate, said footplate thereby superimposable between said first and second plates and thereby frictionally engageable between said first and second plates; and a rubberlike, shock absorbent foot guard disposed arcuately normal the attachment member, said foot guard disposed to curve around the toe of a foot of a user riding in the wheelchair, said foot guard terminating in a position proximal the tarsals of said user's foot;

wherein the footplate of a wheelchair is frictionally engageable in between said first and second plates, said attachment member thereby removably positional in an attached position superimposed upon the footplate, to protectively shield a user's foot from impact with objects disposed within a line of contact when the wheelchair is volubly engaged, whereby a foot of a user riding in the wheelchair is disposed at rest atop the first plate and impacts with the foot guard occurring during normal operation of the wheelchair apply force to compress the foot guard towards the attached position and engage the attachment member in the attached position whereby the attachment member is readily maintainable in the attached position during use.

* * * * *